United States Patent [19]

Moberg et al.

[11] 4,059,300

[45] Nov. 22, 1977

[54] SEAL

[75] Inventors: Sigurd Manfred Moberg, Orange; George A. Lundberg, Pompton Lakes, both of N.J.

[73] Assignee: E. J. Brooks Company, Newark, N.J.

[21] Appl. No.: 630,965

[22] Filed: Nov. 12, 1975

[51] Int. Cl.[2] ..... B65D 63/00

[52] U.S. Cl. ..... 292/322; 24/16 PB

[58] Field of Search ..... 24/16 PB, 30.5 P, 206 A; 292/321, 322, 318, 319, 320; 29/422, DIG. 13, DIG. 21; 425/468

[56] References Cited

U.S. PATENT DOCUMENTS

| | | | |
|---|---|---|---|
| 961,069 | 6/1910 | Crudington | 292/321 |
| 2,659,128 | 11/1953 | Baldwin et al. | 29/422 |
| 2,864,159 | 12/1958 | Doering et al. | 29/422 |
| 3,466,077 | 9/1969 | Moberg | 292/322 |
| 3,537,676 | 11/1970 | Miller | 425/468 X |
| 3,541,833 | 11/1970 | Mercier | 29/422 X |
| 3,718,355 | 2/1973 | Canter | 292/321 |

FOREIGN PATENT DOCUMENTS

| | | | |
|---|---|---|---|
| 1,536,205 | 1/1970 | Germany | 292/322 |

*Primary Examiner*—James T. McCall
*Attorney, Agent, or Firm*—Robert E. Ross

[57] ABSTRACT

A seal of the type having a housing with internal resilient fingers for receiving a shouldered stud in locking engagement, in which a separate cylinder is provided in the housing for closely surrounding the entire periphery of an end portion of the stud protruding beyond the resilient fingers to maintain the stud centered in the opening and prevent any lateral movement thereof, and thereby prevent attempts to open the stud by the insertion of tools to dislodge the resilient fingers from engagement with the stud. The cylinder surrounding the stud is inserted into the end of the housing remote from the stud-receiving end, and said remote end is then deformed with heat to retain the cylinder in the housing.

3 Claims, 8 Drawing Figures

SEAL

BACKGROUND OF THE INVENTION

In U.S. Pat. No. 3,466,077 there is illustrated a one-piece all plastic seal, which comprises a cylindrical housing open at one end only, a group of resilient fingers disposed about the inside surface of the housing and having flexible ends extending toward the closed end thereof, and a shackle integral with the housing at one end, the distal end thereof having a shouldered stud adapted to be inserted into the open end of the housing, whereupon the resilient fingers lock behind the shoulder of the stud, so that attempted disengagement of the stud from the socket causes fracture of the shackle.

It has been found that with sufficient time available and with the proper instrument, such as a thin flexible blade, the seal as described in the above identified patent can be opened without substantial evidence of tampering. This may be accomplished in one manner by inserting the blade into the housing between the stud and the housing wall. With a tool of proper shape, one or more of the resilient fingers may be flexed outwardly and possibly sideways for enough to cause the plastic at the root of the finger to lose strength and resiliency, after which it may stay in the outermost position, out of engagement with the stud. After the tool is withdrawn, the stud may then be pushed sideways in the housing far enough to dis-engage it from the finger or fingers on the other side of the housing, and the stud can then be withdrawn. On re-insertion of the stud, it will re-engage the remaining fingers and appear to be securely locked, and hence the container will appear to be secure.

In another manner, a portion of the closed end of the housing may be cut off and the fingers manipulated to release the stud. Thereafter the cut-off portion can be replaced by adhesive, and the stud re-assembled after the container protected by the seal has been rifled.

SUMMARY OF THE INVENTION

This invention relates to a seal of the type shown in U.S. Pat. No. 3,466,077, in which means is provided in the housing inwardly of the fingers to closely surround the entire periphery of an assembled stud for preventing lateral movement thereof even if one or more of the fingers are damaged or disengaged from the stud shoulder. In a specific embodiment of the invention, said means is a separate cylinder disposed in the housing beyond the ends of the fingers, said cylinder receiving centrally the end portion of the stud. The cylinder is assembled into the end of the housing remote from the stud-receiving end, and said remote end is then deformed with heat to retain the cylinder in the housing.

In another embodiment of the invention said means is a coneshaped member disposed in the housing beyond the ends of the fingers, with the end portion of the wall heat formed inwardly over the dome-shaped member. The dome-shaped member may have a forwardly extending projection which is heat formed into the space at the end of the inwardly formed wall to give the end an appearance of having been injection molded, to discourage attempts to open the seal at that point.

DESCRIPTION OF THE ILLUSTRATED EMBODIMENT

Figure 1:
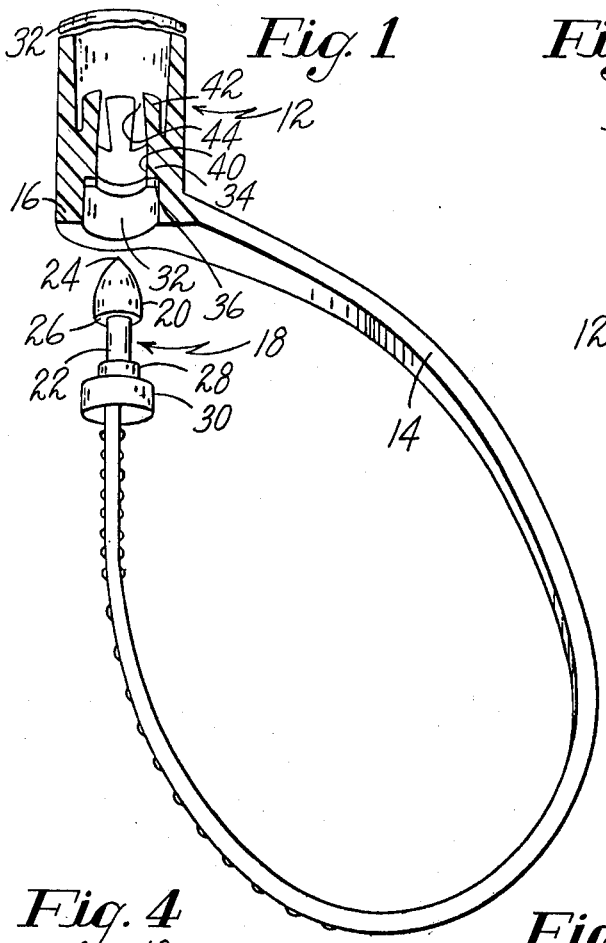
FIG. 1 is a perspective view of a seal of the type described, with the housing portion partly broken away, prior to the assembly of the stud centering collar and prior to the closing of one end of the housing.
Figure 2:
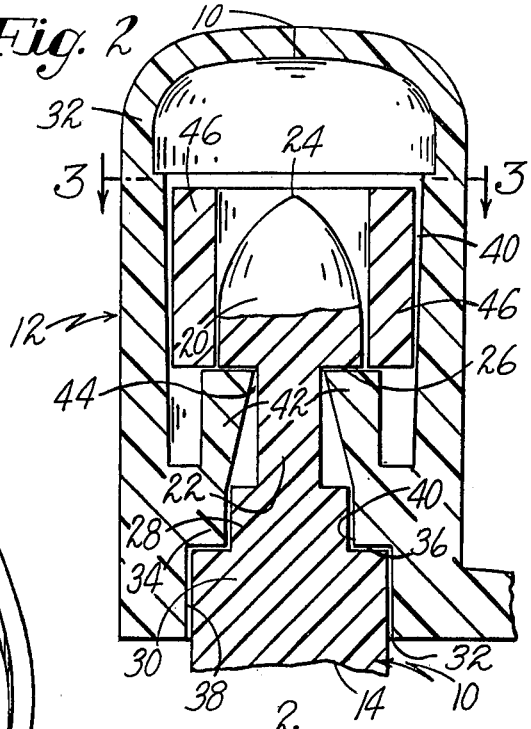
FIG. 2 is a view in section on line 2—2 of FIG. 3 illustrating the housing after the stud-centering collar has been assembled therein and the end of the housing closed.
Figure 3:
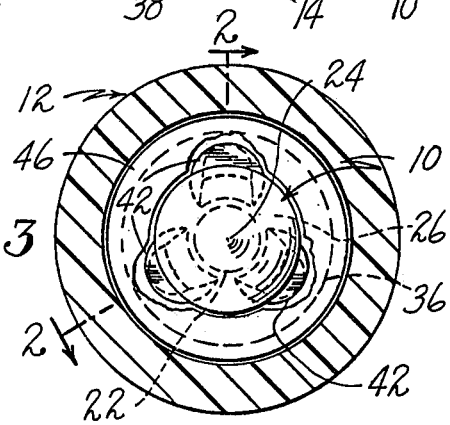
FIG. 3 is a view in section taken on line 3—3 of FIG. 2.
Figure 4:
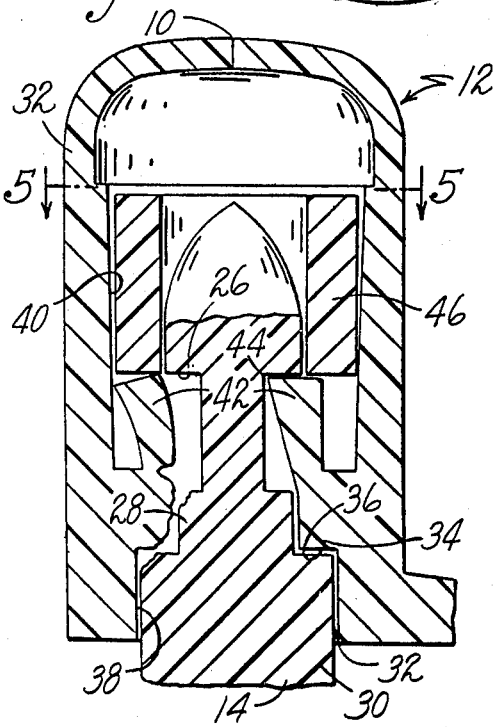
FIG. 4 is a view in section taken on line 4—4 of FIG. 5 illustrating the action of the collar in maintaining the stud centered when one of the locking fingers is damaged so as to be out of engagement with the stud.
Figure 5:
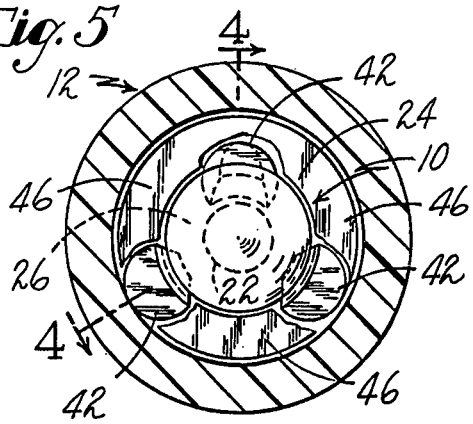
FIG. 5 is a view in section taken on line 5—5 of FIG. 4.

Referring to FIGS. 1–5 of the drawing, there is illustrated a seal 10, which in the illustrated embodiment is formed of a single piece of injection molded plastic such as polyethylene.

The seal 10 comprises a housing 12 and a shackle 14 integral at one end with an end 16 of the housing. The shackel 14 is in the form of a flexible elongated strap, having at its distal end a stud 18 which comprises an elongated enlarged head 20 disposed on the end of a neck 22. The head 20 disposed on the end of a neck 22. The head 20 has a rounded forward portion 24 and a rearwardly facing shoulder 26.

Disposed between the neck 22 and the flexible portion of the shackle are a pair of cylindrical plug portions 28 and 30 which assist in closing the housing opening when the seal is assembled, as will appear hereinafter.

The housing 12, when originally molded is in the form of a hollow shell, with the end 32 open. To provide means in the housing for receiving the stud in locking engagement, the end 16 of the housing is provided with a relatively thick wall portion 34, forming a central aperture. The wall 34 has a step 36 so that the aperture has an outer portion 38 and an inner portion 40 corresponding in size to the plugs 28 and 30 on the end of the shackle.

Extending upwardly into the housing from the inner end of the thick wall portion 34 are a series of resilient fingers 42 which are spaced inwardly from the housing wall and have inner surfaces that are inclined inwardly to form a restricted entrance 44 to the interior of the housing.

The diameter of the head 20 of the stud is slightly smaller than the diameter of the inner portion 40 of the aperture, so that when the stud 18 is assembled with the housing the rounded nose 24 of the stud cams the fingers 42 outwardly to allow the head 20 to pass between the fingers, after which they flex back to their original position to seat behind the shoulders 26 and lock the stud in the housing, with the plugs 28 and 30 seated in the aperture portions 38 and 40.

As previously stated, it is sometimes possible to open a seal of the type described in U.S. Pat. No. 3,466,077, with a tool of the proper shape, by deforming one or more of the fingers 42 after the stud is assembled, so that the finger or fingers no longer seat behind the shoulder 26 of the stud. The stud may then be shifted or tilted sideways out of engagement with the fingers on the opposite side and removed from the housing. After the contents of the container have been pilfered, the stud may be re-inserted into the housing, where it is retained by the undamaged fingers, giving the appearance of not having been tampered with.

To prevent the seal from being opened in this manner, it is desirable to provide means in the housing to more closely surround the head of the assembled stud. Although it would be desirable for economy of manufacture to form the means by molding, it has been found impossible to do so, because of the necessary diameter of the interior of the housing radially outwardly of the locking fingers, since the diameter at this point must be greater than the diameter of the head by a distance at least equal to twice the thickness of the fingers molding an undercut of this depth is impractical to produce in a commercial molding operation.

In the embodiment of the invention illustrated in FIGS. 1–5, the means for centering the stud comprises a separate collar 46, having an outside diameter substantially as great as the inside diameter of the housing and an inside diameter slightly larger than the diameter of the head 20 of the stud. The collar 46 is inserted into the open end 32 of the housing, and said end is then closed by curling the end of the housing wall inwardly, by the use of suitably shaped heated dies so that the resulting exterior surface of the end of the housing has a smooth surface, giving the appearance of having been injection molded, to thereby discourage attempts to open the housing at this point for access to the fingers. The inwardly curled end of the housing wall also serves to retain the collar in position closely adjacent the ends of the fingers.

With the collar 46 in position, when the stud 18 is assembled with the housing, the head 20 of the stud projects forwardly from the ends of the fingers into the collar and is closely surrounded by the inner surface thereof.

After such assembly, if one or more of the fingers 42 are damaged in such a manner as to become disengaged from the stud, (see FIGS. 4 and 5) the stud will remain securely locked in the housing, since the presence of the collar 46 prevents lateral shifting or tilting of the stud, and therefore prevents disengagement of the shoulder 26 from the remaining finger or fingers.

The plug portions 28 and 30 assist in preventing tilting and also provide further obstruction to penetration by any form of tool.

The collar 46 may be formed of metal or plastic. If the latter it may be formed of a material of the type that contracts on heating so that if an attempt is made to open the seal by heating the area around the fingers, the collar will shrink around the end of the stud and lock it into place.

Figure 6:
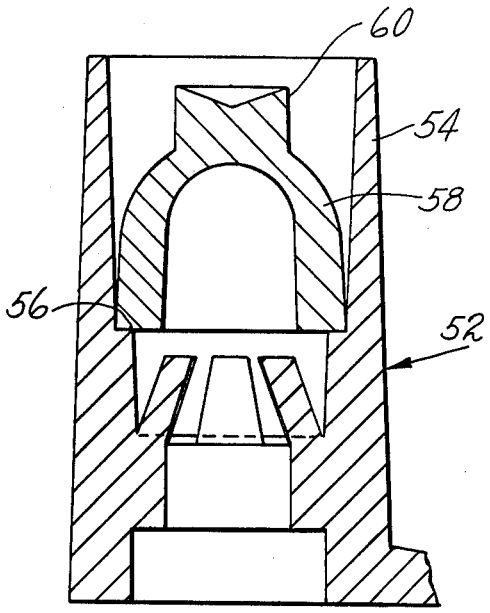
FIG. 6 is a view elevation, partly in section, of a seal of the type described, with a modified form of stud-centering collar assembled therein.
Figure 7:
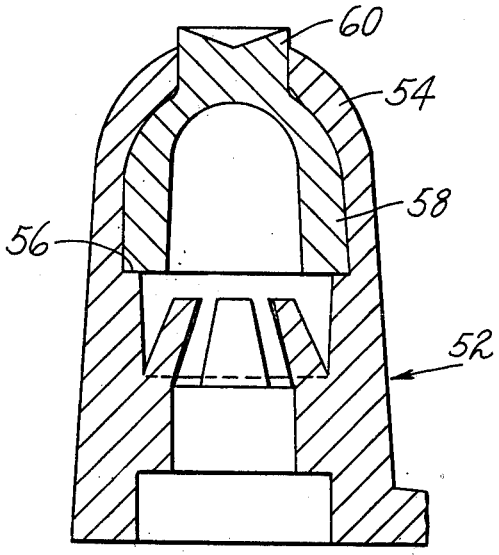
FIGS. 7 and 8 are views similar to FIG. 6 illustrating subsequent steps in the assembly with the housing of the modified form of collar.
Figure 8:
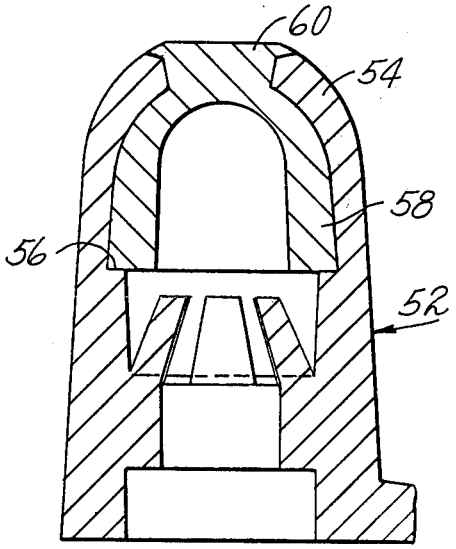

Referring now to FIGS. 6–8, there is illustrated a modified form of socket housing assembly, comprising a housing 52 similar to the housing 12 of the modification of FIGS. 1–5. As in the previous modification the housing is originally molded with an upstanding peripheral wall 54 at the end opposite the stud-receiving end, with an internal shoulder 56. An insert having a lower dome-shaped portion 58 and an upwardly extending projection 60 is assembled into the upper end of the socket, the lower edge thereof resting on the shoulder 56.

Thereafter the wall 54 is curled inwardly by the use of a suitably shaped die, (not shown) so that the wall overlies the dome-shaped portion and closely surrounds the upwardly projecting portion 60. Heat may be provided during this forming operation either by heating the die or otherwise, sufficient to insure that there is no spring-back of the walls when the die is removed.

The upper end of the portion 60 is then deformed by a suitable tool, with sufficient heat to cause melting, so that said end is spread laterally over the adjacent portion of the wall, and welded thereto, and the upper end of the socket is given a smoothly rounded surface giving the appearance of having been injection molded, for the reasons set forth hereinbefore.

Hence any attempt to deseat the seal by cutting the housing open to release the stud, and re-assembling the housing portions with adhesive will leave evidence of tampering, and is made more difficult by reason of the fact that the thickness of plastic at the closed end of the housing is increased.

Since certain obvious changes may be made in the illustrated device without departing from the scope of the invention, it is intended that all matter contained herein be interpreted in an illustrative and not a limiting sense.

I claim:

1. The method of making a locking seal, comprising the steps of molding a seal blank having an elongated housing open at both ends and an integral shackel extending therefrom, said shackle having a stud on the remote end with an enlarged head forming a rearwardly facing shoulder, said housing having a series of fingers disposed therein having free ends spaced from the internal surface of the housing and extending toward one end of the housing, assembling into said one end of the housing a stud centering collar, said collar having a central opening adapted to receive the enlarged head of an assembled stud, and closing said one end of the housing to confine the collar between the free ends of the fingers and the closed end.

2. In a method of making a locking seal in which a seal blank is molded with a shackle having a stud at one end and a socket at the other, said stud having an enlarged head on a reduced neck forming a locking shoulder, said socket comprising a housing and having internal fingers sized and positioned to engage the stud when inserted from one end, the other end having a wall forming an open end, the improvement comprising the steps of inserting into the open end a member having a lower collar portion having an internal recess sized and shaped to closely endorse the head of an assembled stud and a medial attaching post projecting forwardly therefrom, forming the wall inwardly so that said wall overlies the member and surrounds the post, and deforming the end of said post with heat and pressure so that it spreads laterally over the adjacent wall portion and is welded thereto.

3. A method as set out in claim 2 in which sufficient heat is provided in the deforming of the end of the post that the outer surface of the resulting closed end of the socket is provided with the appearance of having been injection molded.

* * * * *